US005139386A

United States Patent [19]

Honegger et al.

[11] Patent Number: 5,139,386

[45] Date of Patent: Aug. 18, 1992

[54] APPARATUS FOR THE STACKING OF PRINTING PRODUCTS ARRIVING IN AN IMBRICATED FORMATION

[75] Inventors: Werner Honegger, Tann Ruti; Jakob Wetter, Wetzikon, both of Switzerland

[73] Assignee: Ferag AG, Hinwil, Switzerland

[21] Appl. No.: 541,594

[22] Filed: Jun. 21, 1990

[30] Foreign Application Priority Data

Jun. 23, 1989 [CH] Switzerland ..... 358/89

[51] Int. Cl.[5] ..... B65G 57/09

[52] U.S. Cl. ..... 414/794.4; 271/283; 271/310; 414/790.8; 414/913

[58] Field of Search ..... 271/283, 285, 303, 310; 414/790.8, 788.8, 797, 913, 794.4

[56] References Cited

U.S. PATENT DOCUMENTS

| | | | |
|---|---|---|---|
| 2,718,958 | 9/1955 | Steen et al. | 271/283 X |
| 2,906,189 | 9/1959 | Robertson | 271/283 X |
| 3,683,758 | 8/1972 | Feldkamper | 414/788.8 X |
| 4,333,559 | 6/1982 | Reist | 198/461 |
| 4,350,330 | 9/1982 | Brown | 414/797 X |
| 4,647,265 | 3/1987 | Uno | 414/790.8 X |
| 4,652,197 | 3/1987 | Littleton | 414/790.8 |

FOREIGN PATENT DOCUMENTS

| | | | |
|---|---|---|---|
| 0013920 | 8/1980 | European Pat. Off. . | |
| 0173959 | 3/1986 | European Pat. Off. . | |
| 2088341 | 6/1982 | United Kingdom | 414/797 |

OTHER PUBLICATIONS

Patent Abstract of Japan, vol. 9, No. 198, Aug. 15, 1985.

*Primary Examiner*—Robert J. Spar
*Assistant Examiner*—Janice Krizek
*Attorney, Agent, or Firm*—Bell, Seltzer, Park & Gibson

[57] ABSTRACT

Printing products (13) are fed by a conveyor track (11, 14) to a stack compartment (17), which can be charged from above, in an imbricated formation of the kind in which the printing products (13) lie in pairs congruently one on top of the other. In order to be able to form stacks containing an odd number of printing products, a retaining device (24) is provided, adjoining the exit of the conveyor track (11, 14), which retaining device upon activation temporarily lifts the upper printing product (13) off the one lying underneath.

8 Claims, 2 Drawing Sheets

APPARATUS FOR THE STACKING OF PRINTING PRODUCTS ARRIVING IN AN IMBRICATED FORMATION

The present invention relates to an apparatus for the stacking of printed products arriving in an imbricated formation in which the printed products lie in pairs congruently one on top of the other.

It is specified in Swiss patent specification 637,091 (substantially identical in content to European patent specification 0,013,920 and U.S. Pat. No. 4,333,559) how and why an imbricated formation is produced, in which the printing products lie in pairs congruently one on top of the other. What is to be regarded as probably the most important reason for forming such an imbricated formation is that, especially with relatively thin printing products, the speed of the conveying device adjoining the printing press and carrying the printing products away can be reduced to about half with the same throughput per unit of time.

If stacks or bundles are to be formed from such an imbricated formation, the double occupancy of each "place" in the imbricated formation has the effect that a formed stack or formed bundle always contains an even number of printing products.

One printing product too many in a stack which should in fact contain an odd number of printing products would admittedly be tolerable. If, however, one considers a complete run of printing products (as a rule far in excess of 100,000), such excess numbers of products per stack or bundle add up to quite a number.

This is where the invention comes in, the object of which is to design an apparatus of the type mentioned at the beginning in such a way that the production of stacks with an odd number of printing products is also accomplished with a "double-occupied" imbricated formation.

The above and other objects and advantages of the present invention are achieved in the embodiment illustrated herein by the provision of a stacking apparatus which comprises a vertical stack compartment for receiving the printed products, with the stack compartment being open at its upper end. A conveyor track is positioned ahead of and above the stack compartment for delivering the printed products to be stacked in an imbricated formation to the upper end of the stack compartment, and with the printed products lying in pairs congruently one on top of the other. Counting means is positioned along the conveyor track for counting the printed products conveyed along the conveyor track, and product retaining means is positioned in the region of the end of the conveyor track for selectively and temporarily acting upon the upper of a pair of overlying printed products upon activation by the counting means so as to temporarily lift the upper of a pair of printed products from the lower printed product of the pair.

The invention is described in more detail below with reference to an exemplary embodiment represented in the drawing, in which.

Figure 1:
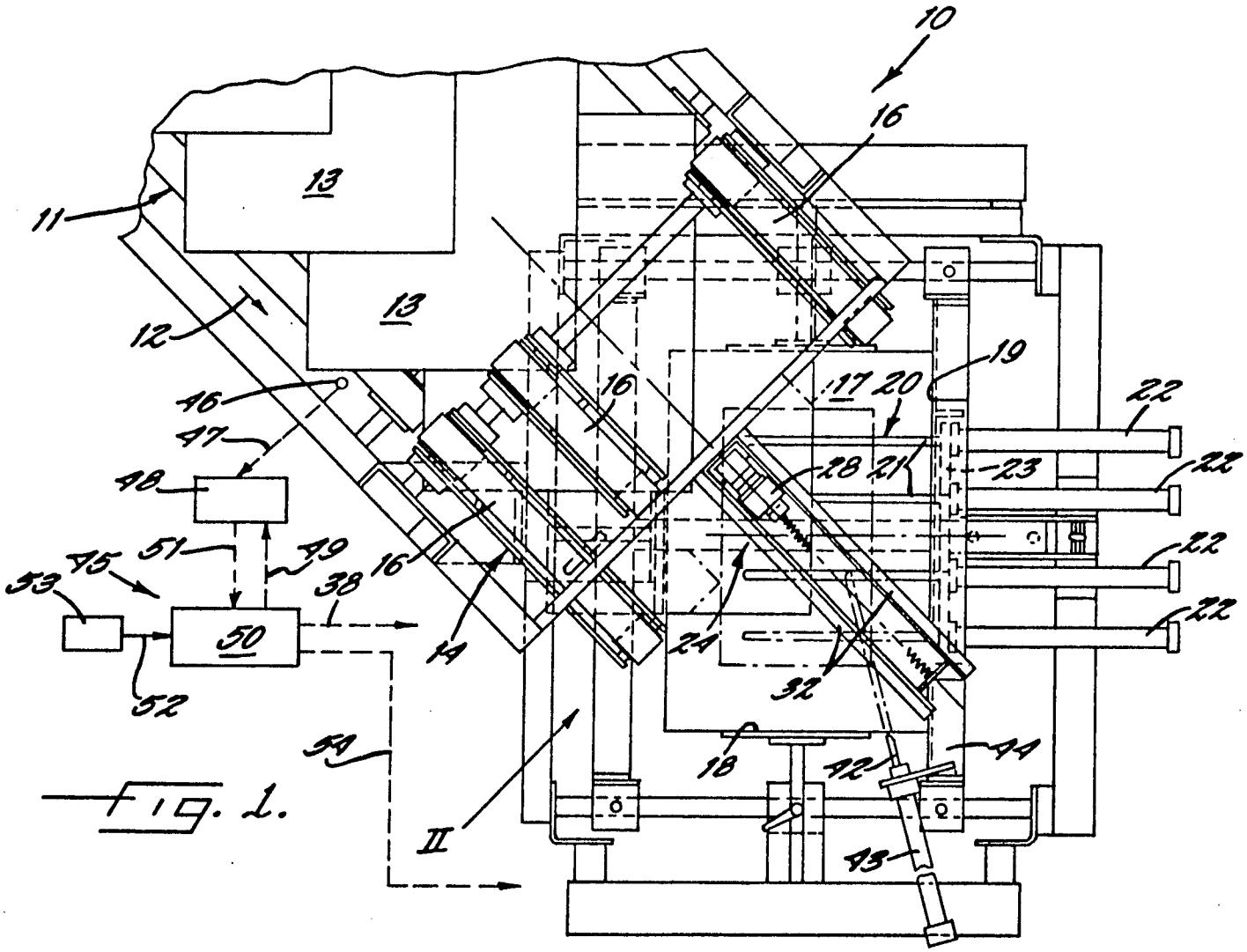
FIG. 1 shows a diagrammatic plan view of a stacking apparatus.
Figure 2:
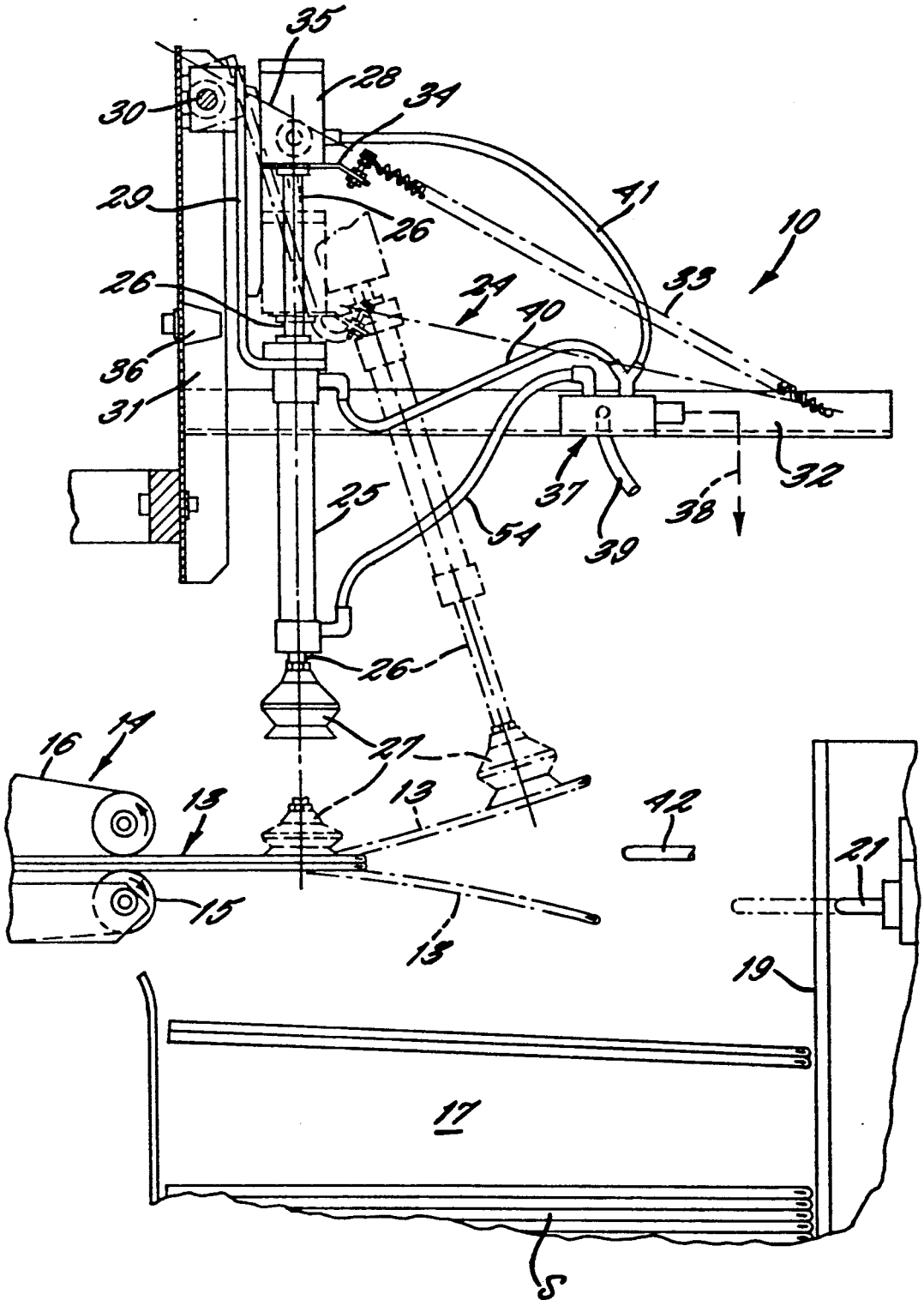
FIG. 2 shows, on an enlarged scale, a simplified view of the apparatus of FIG. 1, approximately from the direction of the arrow II of FIG. 1.

On the apparatus 10 represented in FIGS. 1 and 2, a band conveyor 11 can be seen, which feeds printing products 13, in the direction of the arrow 12, in an imbricated formation, in which one corner of the printing products 13 leads. The band conveyor 11 is adjoined by a further band conveyor 14, which has both lower bands 15 (FIG. 2) and upper bands 16, between which the printing products 13 are clamped in pairs lying congruently one on top of the other and are fed to a stack compartment 17 which can be charged from above.

The stack compartment 17 is limited laterally by a stop plate 18 and by stop rails 19, both of which can be horizontally adjusted and fixed, in order to adapt the clear dimensions of the stack compartment 17 to the format of the printing products arriving.

As FIG. 2 reveals, in the case of the present apparatus, the printing products 13 fed in pairs to the stack compartment drop either onto a stack table (not shown) forming the bottom of the stack compartment, or—for example in the time when a stack has to be removed from the stack table—onto a carrying fork 20 (FIG. 1), the prongs of which are formed by piston rods 21, passing through the stop rails 19, of piston-cylinder units 22, which for their part are fastened to a common carrier 23 which can be displaced back and forth along the stop rails 19. A retaining device 24 is provided, adjoining the exit of the band conveyor 14. The returning device 24 has a pneumatic cylinder 25, the tubular piston rod 26 of which is led out of the cylinder 25 at both ends. At the lower end, the piston rod 26 bears a suction cup 27 in the form of a bellows, to which low pressure is fed through the piston rod 26 from a suction pump 28, fitted on the upper end of the piston rod 26. The suction pump 28 is operated by compressed air. The upper end of the cylinder 25 is fastened to a bracket 29, which for its part is suspended on a frame part 31 of the apparatus such that it can swivel in the vertical plane about a pin 30. From the frame part 31 there projects an extension arm 32, on which the one end of a tension spring 33 is hung. The other end of the tension spring 33 is hung on a link plate 34, fastened to the upper end of the piston rod 26. The dot-dashed line 35 indicates the direction of the tension spring 33 in the position of the retaining device 24 shown by solid lines in FIG. 2. It can be seen that, in this position, the direction of the tension spring 33 runs above the pin 30, so that this spring 33 has the tendency to hold the retaining device 24 in the position represented by solid lines. However, as soon as the piston rod 26 is extended downwards, the tension spring 33 acts in the opposite sense. There is also fastened to the frame part 31 a buffer 36, which prevents a hard impact of the bracket 29 against the frame part 31 on return of the cylinder 25 from the swivelled position into the unswivelled position.

On the extension arm 32 there is also fitted an electromagnetic five/two-way valve 37, which can be actuated via an electric line 38. A feed line 39, connected to a compressed-air source (not shown), leads to this valve 37.

In the unactuated position, the valve 37 does not pass on the compressed air which is in the feed line 39. In the one position, the valve 37 connects the feed line 39 to the lines 40 and 41, with the result that on the one hand the piston rod 26 extends downwards with the suction cup 27 and on the other hand the suction pump 28 is at the same time activated. This has the effect that the suction cup 27 sucks firmly onto the upper printing product 13 of the pair leaving the band conveyor 14. However, the band conveyor 14 continues in operation and the upper printing product 13 seized by the suction cup 27 is advanced and thus—together with the tension spring 33—brings the cylinder 25 into the position represented by dot-dashed lines in FIG. 2, whereby the upper printing product 13 is lifted off the one lying underneath. At this moment, a separating finger 42 (only represented diagrammatically in FIG. 2) is pushed forward, which maintains the separation of the two printing products 13 until the lower of these printing products has dropped onto the already existing stack S and the prongs of the carrying fork 20 are extended and ready to receive the copy which was previously on top in a pair of printing products 13.

In the other position of the valve 37, a line 54, leading to the lower end of the cylinder 25, is supplied with compressed air, with the consequence that the suction pump 28 is switched off, the suction cup 27 releases the upper printing product, the piston rod 26 is retracted and the cylinder 25 is returned to the initial position.

FIG. 1 reveals that the separating finger 42 is formed by the piston rod of a further pneumatic cylinder 43, which is fastened to a further frame part 44. In FIG. 1, a control device 45 is represented, again very diagrammatically. Said control device has a light barrier 46, which is periodically interrupted by the sawtooth-shaped lateral edge of the imbricated formation running through the end of the band conveyor 11 and is connected via a line 47 to a presettable and resettable counter 48. This counter 48 is preset and reset via a line 49 by a programmable control unit 50 and supplies to the latter the counting value reached, via a further line 51. The control unit 50 is connected via a line 52 to an input unit 53, which can be used to input how many stacks or bundles of how many printing products are to be formed. The control unit 50 then actuates the valve 37 via the incoming line 38 already mentioned, and the cylinder 43 and the cylinders 22 via a further line 54 as well as via further valves (not shown).

With the apparatus described, consequently any stack with an even or an odd number of printing products can be formed from an imbricated formation with "double occupancy". It must be noted here that the proposed apparatus is not confined to imbricated formations in which one corner of the printing products leads in each case, but can also be applied to conventional imbricated formations, in which a side edge of the printing products leads.

While in the exemplary embodiment described the retaining device 24 consists essentially of the suction cup 27 able to be swivelled with the pneumatic cylinder 25, it is conceivable to provide instead of the suction cup 27 an endless, tracking suction belt which can be activated in a controlled manner and follows a corresponding path. In the case of relatively thick printing products, a purely mechanical retaining device may also be provided, for example something like a separating finger in the form of a tongue. All that is important is that the upper printing product of a pair is temporarily prevented from dropping together, that is to say simultaneously with the lower printing product, into the stack compartment 17.

We claim:

1. An apparatus for the stacking of printed products (13) arriving in an imbricated formation in which the printed products (13) lie in pairs congruently overlying each other, comprising:

a vertical stack compartment (17) for receiving the printed products (13), the stack compartment (17) being open at its upper end, a conveyor track (11, 14) having a discharge end positioned adjacent and above the stack compartment (17) for delivering the printed products (13) to be stacked in an imbricated formation to the upper end of the stack compartment (17), and with the printed products (13) lying in pairs congruently one on top of the other, counting means (46, 47, 48) positioned along the conveyor track (11, 14) for counting the printed products (13) conveyed along the conveyor track (11, 14), and product retaining means (24) positioned adjacent said discharge end of the conveyor track (11, 14) for selectively and temporarily acting upon the upper one of each pair of overlying printed products (13) upon activation by said counting means (46, 47, 48) so as to temporarily lift the upper one of each pair of printed products (13) from the lower printed product (13) of each pair, said product retaining means (24) including at least one suction cup (27), and means for selectively lowering said suction cup from above onto said upper one of each pair of printed products (13) and subsequently raising said suction cup.

2. The apparatus as claimed in claim 1, wherein said one suction cup (27) is fitted at the end of a piston rod (26) and said lowering and raising means comprises a cylinder-piston unit (25).

3. The apparatus as claimed in claim 2, wherein said cylinder-piston unit (25) is suspended such that it can swivel in a vertical plane which is parallel to the conveying direction of the conveyor track (11, 14) and between an unswivelled position and a swivelled position.

4. The apparatus as claimed in claim 2, wherein said piston rod (26) is tubular and extends on both sides out of the cylinder of the cylinder-piston unit (25), and mounts at the end opposite the suction cup 927) low pressure source means (28) for supplying low pressure through the piston rod (26) to the suction cup (27).

5. The apparatus as claimed in claim 3, wherein one end of a tension spring (33) acts on the end of the piston rod (26) opposite the suction cup (27), said tension spring being positioned such that the tensile force thereof draws the cylinder piston unit (25) into said unswivelled position when the suction cup (27) is raised and draws it into said swivelled position when the suction cup (27) is lowered.

6. The apparatus as claimed in claim 4, wherein said low pressure source means includes a suction pump (28) operated by compressed air.

7. The apparatus as claimed in claim 6, wherein an electromagnetic five/two-way valve (37) supplies compressed air both to the cylinder-piston unit (25) and to the suction pump (28).

8. The apparatus as claimed in claim 1, further comprising at least one separating finger (42), and means for moving said one separating finger into the stack compartment (17) simultaneously with the activation of the product retaining means (24), to ensure the separation of said upper one of each pair of printed products (13) from said lower printed product of each pair.

* * * * *